United States Patent [19]

Wise

[11] 4,446,971

[45] May 8, 1984

[54] LIQUID CONTAINER WITH STRAW OPENING MEANS

[75] Inventor: Daniel J. Wise, Farmington, Mich.

[73] Assignee: Ex-Cell-O Corporation, Troy, Mich.

[21] Appl. No.: 440,664

[22] Filed: Nov. 10, 1982

[51] Int. Cl.[3] ..... B65D 5/54; B65D 5/70

[52] U.S. Cl. ..... 206/607; 206/608; 206/628; 206/633; 229/17 R

[58] Field of Search ..... 206/607, 608, 628, 633; 229/7 R, 17 R

[56] References Cited

U.S. PATENT DOCUMENTS

| | | | |
|---|---|---|---|
| 3,263,900 | 8/1966 | Link | 206/607 |
| 3,438,565 | 4/1969 | Lugt | 206/607 |
| 3,786,983 | 1/1974 | Hennessey | 206/628 |
| 3,970,215 | 7/1976 | McLaren | 206/608 |
| 4,159,771 | 7/1979 | Komatsu | 206/608 |
| 4,244,474 | 1/1981 | Wise | 206/612 |
| 4,252,236 | 2/1981 | Roccaforte | 206/607 |
| 4,318,479 | 3/1982 | Lisiecki | 206/633 |

*Primary Examiner*—William Price
*Assistant Examiner*—Gary E. Elkins
*Attorney, Agent, or Firm*—John P. Moran

[57] ABSTRACT

A heat sealable, liquid carrying paperboard carton is disclosed having straw opening means formed in a wall panel thereof. The straw opening means includes a tear strip formed by cuts through the carton wall beginning at the edge of the side panel adjacent the usual underlying fifth panel. A tab is formed to serve as an extension of the tear strip. A block score depression is formed in the wall panel adjoining the tear strip such that the tab is folded onto the depression and sealed thereto, but only minimally due to the depth of the depression, so as to be readily lifted therefrom to initiate the straw hole opening process.

3 Claims, 5 Drawing Figures

LIQUID CONTAINER WITH STRAW OPENING MEANS

TECHNICAL FIELD

This invention relates generally to liquid carrying paperboard cartons or containers, and, more particularly, to such containers provided with improved means for readily forming an opening for inserting a straw therein.

It is essential that liquid carrying paperboard containers reach the consumer in a convenient, safe and sanitary condition, and also be capable of retaining such sanitary condition while being handled, and the contents thereof consumed, by schoolchildren and adults alike. Where straw opening means are provided on such containers, such means must also measure up to the convenience, safety and sanitation requirements.

BACKGROUND ART

U.S. Pat. No. 3,770,185 provides for a straw opening means wherein parallel score lines are cut from one side of one vertical wall above the gable, each to a depth of from 40 to 75 percent of the wall thickness. Such score lines form a tear strip extending from the upper vertical edge, along the width of the vertical wall and onto one gable. A "thumb notch" is formed on the uppermost edge of the other vertical wall to facilitate the opening process. Once the tear strip is torn away along the lines defined by the parallel score lines, a plug of material encompassed by the circular score line remains intact with the tear strip to expose a hole for receiving a straw.

U.S. Pat. No. 4,244,474 provides for a straw opening means wherein spaced apart score lines are formed to extend laterally from the edge of a conventional gable top roof panel lying adjacent the panel interconnecting-side seam flap, to a depth of at least halfway through the paperboard, forming a tear strip such that when the tear strip is peeled or torn away past the free edge of the side seam panel, a weakened area is exposed which may be penetrated by the pressing of a straw thereagainst. In one embodiment, an extended tab is formed by notching the side seam panel of an adjacent carton blank in the cut-off operation from a paperboard roll.

U.S. Pat. No. 4,318,479 discloses side panel straw opening means wherein a cooperating tab and notch are formed on overlapping side panels such that peeling back the tear strip exposes the notch therebeneath as an opening for the insertion of a straw after the overlapped side panel assembly has been rotated into a top position.

DISCLOSURE OF INVENTION

An object of the invention is to provide a liquid carrying container and blank therefor, including improved means for providing a sanitary straw opening on a side thereof without having to open a pouring spout.

Another object of the invention is to provide a liquid carrying, paperboard container including an improved straw opening means associated with adjacent wall panels, rather than with a conventional gable top.

A further object of the invention is to provide a liquid proof, thermoplastic coated paperboard container including an improved tear strip formed integral with the first side panel and adjacent the edge thereof which overlies the conventional, narrow fifth panel or side seam flap and a specially formed edge portion of the adjacent fourth panel.

Still another object of the invention is to provide a heat sealable flat top container having straw opening means formed at the juncture of the two perpendicular side panels which meet at the underlying side seam panel. The straw opening means includes a tear strip on the side panel overlying the side seam panel and an extended tab on the tear strip which bends onto the other side panel. A block score depression is formed on the latter beneath the tab, minimizing the sealing therebetween and enhancing the manual release of the tab.

These and other objects and advantages of the invention will be apparent when reference is made to the following description and accompanying drawings.

BEST MODE FOR CARRYING OUT THE INVENTION

Figure 1:
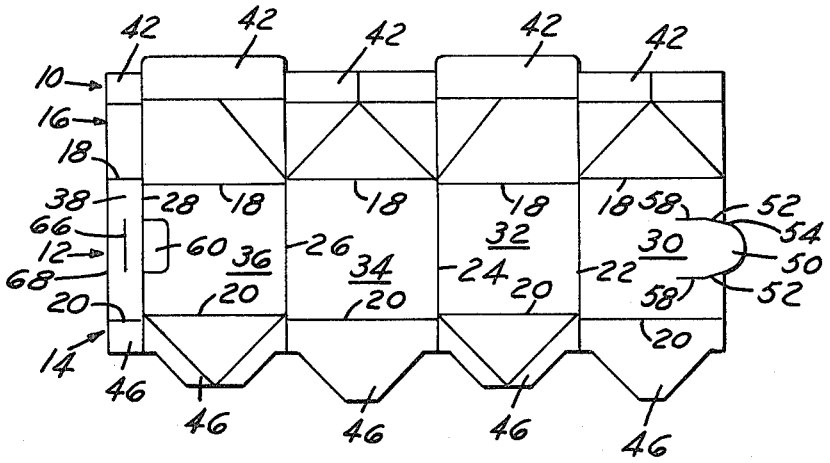
FIG. 1 is a layout view of a blank from which a container embodying the invention may be erected, showing the inside surface thereof and illustrating its relationship to an adjacent blank in the cut-off operation.

Referring now to the drawings in greater detail, FIG. 1 illustrates a paperboard blank 10 formed from kraft paperboard. The paperboard is covered on both sides with a suitable thermoplastic material, such as polyethylene, in order to render a container formed from the paperboard fluid-tight and capable of holding liquids, such as milk or juices.

The container blank 10 includes a body portion 12 which, in the present instance, is substantially square in cross section, but which may be rectangular. At its base the body portion 12 is provided with a suitable bottom end closure portion 14. The upper end of the body portion 12 is provided with a suitable flat top end closure portion 16.

Figure 2:
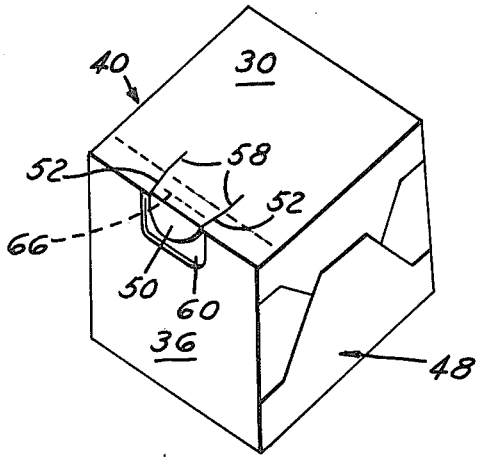
FIG. 2 is a perspective view of a closed and sealed paperboard container embodying the invention.

The flat blank 10 is formed of high-grade paperboard coated with outer and inner layers of polyethylene thermoplastic material. By means of an appropriate pattern of score lines, the blank 10 is divided into a plurality of panels and sections which are utilized for the walls of a container and the top and bottom closure parts when the container is erected therefrom. The central or body portion 12 of the blank 10 becomes the body of the container and is defined by spaced apart transverse score lines 18 and 20, running in substantially parallel relation across the face of the blank. Intersecting the lines 18 and 20 at spaced intervals therealong are a series of perpendicular score lines 22, 24, 26 and 28, which define, in the central and major area of the blank, side or wall panels 30, 32, 34 and 36 together with a fractional side or wall panel or side seam flap 38, sometimes referred to as the fifth panel. When a container 40 (FIG. 2) is erected, the side seam flap 38 is adhesively secured in overlying relation with the side panel 30.

It should be noted that the transverse score lines 18 and 20 are not continuous but are formed in staggered portions interrupted by the perpendicular score lines 22, 24, 26 and 28. The purpose of this staggered scoring is to accommodate the thickness of the paper as the paper is bent along the score lines when the container is erected and thus prevent crowding of the paper at the various junctions of the score lines. This not only enhances the strength and appearance of the finished container but facilitates its erection and closure by automatic machinery.

Integral with the upper ends of the side panels, but separated therefrom by the transverse score line 18, are a plurality of panel extensions 42 which are foldable into a flat top configuration. This may be accomplished in any known manner. As one example, it may be formed initially as a conventional gable top, and then folded into a flat top closure 44 (FIG. 3), as illustrated and described in U.S. Pat. No. 3,869,078, incorporated herein by reference, but forming no part of the present invention.

Integral with the bottom ends of the side panels, but separated therefrom by the transverse score line 20, are a plurality of panel extensions 46 which are foldable into a flat bottom closure (not shown). This may be completed in any suitable known configuration, as, for example, the bottom closure arrangement 48 (FIG. 2), as illustrated and described in U.S. Pat. No. 4,341,340, incorporated herein by reference, but forming no part of the present invention.

Referring once again to FIG. 1, it may be noted that an arcuate-shaped tab 50 is formed at approximately the center of the side panel 30 of the blank 10. A pair of space apart cuts 52 are formed in the side panel 30, extending laterally in FIG. 1 from the junctures 54 of the tab 48 with the edge 56 of the panel 30. The cuts 52 are made completely through the paperboard and extend from the edge 56 a distance which is a predetermined amount less than the width of the side seam panel 38. A pair of substantially parallel score lines 58 extend from the inner ends of the spaced apart cuts 52 to a location beyond the adjacent free edge portion of the underlying side seam panel.

A block score 60 is formed on the side panel 36, laterally aligned with the tab 50 adjacent the vertical score line 28. The block score 60 is preferably slightly longer than the distance between the junctures 54, and slightly wider than the extension of the tab 50 beyond the edge 56. Inasmuch as scores are typically formed so that the resultant depressions are on the outside of the blank, it is apparent that the overhanging tab 50 fits into the depression of the block score 60, to which it adheres less tightly under heat and the pressure of a compression roller or belt as the latter and the plane of the surface of the panel 36 move relative to one another. In other words, due to the depth of the depression, the tab 50 may be more readily released therefrom with minimal fiber tear.

Once the container 40 is formed from the blank 10 it is apparent that the tab 50 is able to be folded around the corner of the container onto the block score 60 on the side panel 36 so as to not interfere with stacking and shipping. Manual release of the tab 50 from the panel 36 is enhanced by having been sealed over the block score 60 portion which has a surface below the outer surface of the side panel 36. This arrangement results in the release of the tab from the panel 36 without causing fiber tear. Once manually lifted from the panel 36 and peeled back from the underlying side seam panel 38, to which it is sealed during the construction process, the tab 50 and resultant tear strip 62 (FIG. 3) are peeled back along the score lines 58, beyond the inner exposed edge of the side seam panel 38, forming a flexible hinge at the inner ends of the score lines 58.

Figure 3:
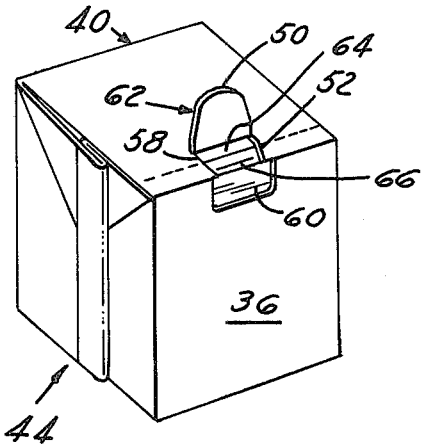
FIG. 3 is a perspective view of the FIG. 2 container with the tear strip shown in an open condition.

As shown in FIG. 3, such peeling back of the tear strip 62 along the cuts 52 and the score lines 58 forms an opening 64 adaptable to having a straw extended therethrough. Hence, the need for a gable top and typical pour spout on a container, such as a milk carton, is eliminated. This is particularly applicable to single service type half-pint and/or small cross-section carton sizes.

In the event the tear strip 62 does not peel cleanly from the underlying side seam panel 38 to expose the opening 64, it may be desirable to form a slit 66 (FIG. 1) through the thermoplastic coating, intermediate the edge 68 and the score line 28. This has been found to enhance a clean opening operation.

It is apparent that, since there is no conventional top pouring spout required, the panel 30, formerly referred to as a side panel, may now serve as a top panel, and the inked printing may be formed on the various panel surfaces accordingly.

Figure 4:
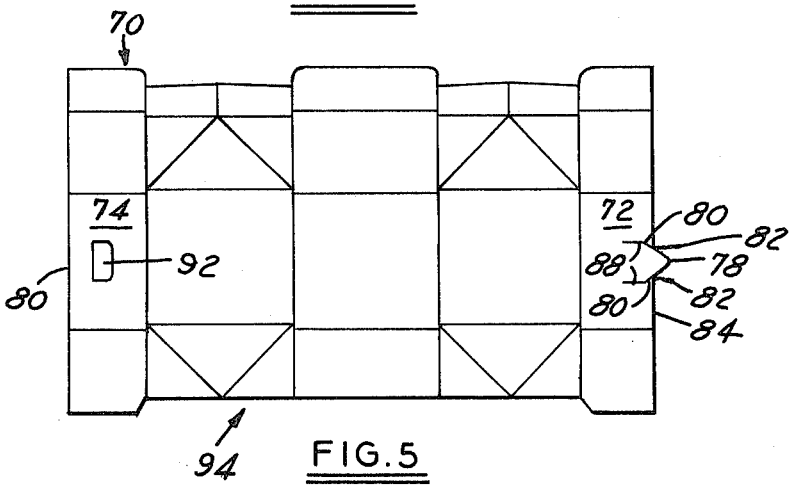
FIG. 4 is a layout view of a blank from which a container embodying another alternate embodiment of the invention may be erected.
Figure 5:
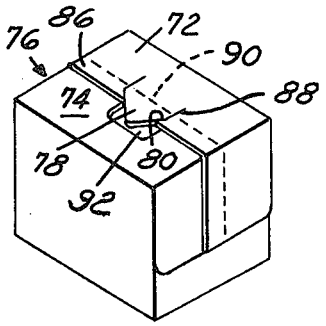
FIG. 5 is a perspective view of a closed and sealed paperboard container formed from the blank of FIG. 4.

In the alternate embodiment shown in FIGS. 4 and 5, it may be noted that the blank 70 of FIG. 4 includes first and fifth side wall panels 72 and 74 which are of such predetermined widths that a so-called "center side seam" type container 76 (FIG. 5) is produced by the conventional forming and sealing of the blank 70. A tab 78 is formed at approximately the center of the panel 72. As illustrated, a pair of spaced apart cuts 80 are formed on the panel 72, extending laterally in FIG. 4 from the junctures 82 of the tab 78 with the edge 84 of the panel 72. The cuts 80 are made completely through the paperboard and extend from the edge 84 a distance which is just short of the overlap of the panels 72 and 74, as represented at 86 in FIG. 5. A pair of substantially parallel scorelines 88 are formed to extend from the inner ends of the spaced apart cuts 80 to provide a straw hole opening 90 beyond the overlapped portion 86, substantially in the center of the container panel formed by the sealing together of the overlapped panels 72 and 74, after the tab 72 is peeled back along the cuts 80 and the scorelines 88. A block score 92, similar in size to the block score 60, is formed on the fifth side panel 74 laterally aligned with the tab 72, for the same purpose as the block score 60 relative to the tab 50. The bottom closure arrangement 94 shown is similar to the arrangement disclosed in U.S. Pat. No. 3,120,335, except for the widths of the first and fifth wall panels 72 and 74.

INDUSTRIAL APPLICABILITY

It should be apparent that the invention provides an efficient and sanitary means for facilitating the use of a straw with a liquid carrying carton. The above described arrangements would be applicable to blanks which are mirror images of the blanks 10 and 70.

It should also be apparent that the need for an abhesive or sealing inhibitor beneath the tabs 50 and 72 to facilitate the manual opening process is virtually eliminated by the inclusion of the respective block scores 60 and 92.

While but two embodiments of the invention have been shown and described, other modifications thereof are possible.

The embodiments of the invention in which an exclusive property or privilege is claimed are defined as follows:

1. In a liquid carrying paperboard container coated overall with a thermoplastic material that serves as a barrier and becomes an adhesive when subjected to heat, and including a tubular body having four sides including first, second, third, fourth and fifth panels, wherein one side includes overlapped and sealed first and fifth panels, the improvement comprising means for forming a straw opening in said tubular body including tear strip means formed on the outer first panel along a pair of spaced apart lines beginning at the edge thereof adjacent the underlying fifth panel and extending laterally a distance just beyond the intermediate edge portion of the underlying panel, and including a tab formed as an extension of said tear strip, with the inner ends of said pair of spaced apart lines defining a flexible hinge therebetween when said tear strip is peeled from said underlying panel, and a block score forming a depression on one of said fourth and fifth panels aligned with said tab and larger in area than the area of said tab such that said tab is sealed less tightly thereto under heat and pressure than other sealed surfaces due to the depth of said depression and, hence, readily releasable therefrom without disturbing any portion of the underlying portion of the panel bearing said depression.

2. The improvement described in claim 1, wherein said depression is formed on said fourth panel.

3. The improvement described in claim 1, wherein said depression is formed on said fifth panel.

* * * * *